US010112282B2

(12) United States Patent
Xue et al.

(10) Patent No.: US 10,112,282 B2
(45) Date of Patent: Oct. 30, 2018

(54) WHEEL DEBURRING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 0 days.

(21) Appl. No.: 15/635,865

(22) Filed: Jun. 28, 2017

(65) Prior Publication Data

US 2018/0001436 A1 Jan. 4, 2018

(30) Foreign Application Priority Data

Jun. 29, 2016 (CN) ..... 2016 1 0492372

(51) Int. Cl.

| | |
|---|---|
| ***B24B 29/00*** | (2006.01) |
| ***B24B 5/44*** | (2006.01) |
| ***B24B 5/08*** | (2006.01) |
| ***B24B 5/40*** | (2006.01) |
| ***B24B 9/04*** | (2006.01) |
| ***B24B 29/04*** | (2006.01) |
| ***B24B 41/06*** | (2012.01) |
| ***B24B 27/00*** | (2006.01) |
| ***B24D 13/14*** | (2006.01) |

(52) U.S. Cl.

CPC ..... *B24B 29/005* (2013.01); *B24B 5/08* (2013.01); *B24B 5/40* (2013.01); *B24B 5/44* (2013.01); *B24B 9/04* (2013.01); *B24B 27/0076* (2013.01); *B24B 29/04* (2013.01); *B24B 41/06* (2013.01); *B24D 13/145* (2013.01)

(58) Field of Classification Search

CPC .. B24B 5/06; B24B 5/065; B24B 5/08; B24B 5/14; B24B 5/16; B24B 5/165; B24B 5/40; B24B 5/44; B24B 9/00; B24B 9/04; B24B 27/0076; B24B 29/005; B24B 33/02; B24B 33/025; B24B 39/023

See application file for complete search history.

(56) References Cited

U.S. PATENT DOCUMENTS 4,527,300 A * 7/1985 Kunde ..... B24B 29/04 15/88.2
5,161,281 A * 11/1992 Hanen ..... B08B 1/04 15/88.3
6,261,160 B1 * 7/2001 Hakomori ..... B23Q 7/04 451/209

(Continued)

*Primary Examiner* — Timothy V Eley
(74) *Attorney, Agent, or Firm* — Maier & Maier, PLLC

(57) ABSTRACT

A wheel deburring device. A second motor drives an upper brush to rotate, second cylinders enable the upper brush to fall through third posts, and burrs of a front surface can be removed when the upper brush is in contact with the front surface of a wheel; a first motor enables an outer ring and a first geared ring to rotate through a first belt; a third motor enables an inner ring and a second geared ring to rotate through a second belt, directions of rotation of the inner ring and the second geared ring are opposite to that of the outer ring, and brushes are driven to rotate through a gear; and fourth cylinders enable a lower brush to rise through first guide posts, and burrs of a back cavity of the wheel can be removed when the lower brush is in contact with that back cavity.

1 Claim, 4 Drawing Sheets

(56) References Cited

U.S. PATENT DOCUMENTS

| | | | | |
|---|---|---|---|---|
| 6,722,961 | B2 * | 4/2004 | Solanellas | B23Q 1/54<br>451/140 |
| 9,724,796 | B2 * | 8/2017 | Xue | B24B 9/04 |
| 9,782,866 | B1 * | 10/2017 | Xue | B24B 9/04 |

* cited by examiner

WHEEL DEBURRING DEVICE

TECHNICAL FIELD

The present invention relates to a deburring device, and in particular to a wheel deburring device, of which an outer ring and an inner ring of a lower brush rotate separately and round brushes can autorotate.

BACKGROUND ART

A deburring procedure is an indispensable procedure of a wheel production process, and the deburring effect will directly affect the painting effect of a follow-up procedure. In the traditional burr brushing mode, the linear velocity of a central position of a large-disc brush is relatively low, and thus the treatment on corner burrs of roots of flanges and corner burrs of roots of rims is not ideal, so that a novel deburring device is urgently required to excellently remove the corner burrs of the roots of the flanges and the corner burrs of the roots of the rims.

SUMMARY OF THE INVENTION

An object of the present invention is to provide a wheel deburring device, which has the advantages that burrs of a front surface and a back cavity of a wheel can be removed, an outer ring and an inner ring of a lower brush rotate separately, round brushes can autorotate, and corner burrs of roots of flanges of wheels and corner burrs of roots of rims of the wheels can be excellently removed.

In order to achieve the object described above, a technical solution of the present invention is as follows: an improved wheel deburring device is composed of a machine frame, first guide posts, a first cylinder, a first motor, a rotary joint, a first belt pulley, a second belt pulley, a third belt pulley, first guide sleeves, a first synchronizing belt, a first rising and falling plate, a large bearing block, a hollow shaft, a spline housing, a spline shaft, a spring, a clamp, a lower brush, a flange sleeve, a conical column, a pressing ring, second guide posts, an upper brush, a rotary shaft, an upper bearing block, a second rising and falling plate, second guide sleeves, third guide posts, third guide sleeves, a second motor, second cylinders, third cylinders, fourth cylinders, a second synchronizing belt, a fourth belt pulley and a third motor; four of first guide posts are fixed between the bottom of the machine frame and a working platform of the machine frame; four of first guide sleeves matched with the first guide posts are mounted on the first rising and falling plate; the first motor, of which an output end is provided with the third belt pulley, is fixed below the first rising and falling plate through a flange; the third motor, of which an output end is provided with the fourth belt pulley, is also fixed below the first rising and falling plate through a flange; the large bearing block is fixed above the first rising and falling plate, and the hollow shaft is mounted inside the large bearing block through a bearing; the spline housing is mounted inside the hollow shaft through a bearing, and the spline shaft is matched with the spline housing; the first cylinder is fixed at the bottom of the machine frame, and an output end of the first cylinder is connected to the downside of the spline shaft through the rotary joint; the first belt pulley is fixed at the downside of the spline housing; the second belt pulley is fixed below the hollow shaft; the second belt pulley and the third belt pulley are connected through the first synchronizing belt; the first belt pulley and the fourth belt pulley are connected through the second synchronizing belt; two of fourth cylinders are both fixed at the bottom of the machine frame, and output ends of the fourth cylinders are hinged to the downside of the first rising and falling plate; and the conical column is matched with the flange sleeve, and the spring is arranged below the conical column. The lower brush is mounted at the upper end of the hollow shaft and the upper end of the spline housing; and the clamp is fixed on the machine frame.

The lower brush is composed of a first connecting plate, a first geared ring, a gear, an outer ring, round brushes, a second geared ring, a second inner ring and a connecting plate. Both the first connecting plate and the first geared ring are fixed below the outer ring; the second geared ring and the second connecting plate are fixed below the inner ring; and a plurality of round brushes are fixed above the gear, and the gear is matched with the first geared ring and the second geared ring.

Four of the second guide posts are separately fixed above the pressing ring, four of the second guide sleeves matched with the second guide posts are fixed at the top end of the machine frame; two of the third cylinders are also fixed at the top end of the machine frame, and output ends of the third cylinders are hinged to the upside of the pressing ring; the upper bearing block is fixed below the second rising and falling plate, and the rotary shaft is mounted in the upper bearing block through a bearing; the upper brush is fixed at the lower end of the rotary shaft; the second motor is fixed above the second rising and falling plate, and an output end of the second motor is connected to the upside of the rotary shaft; four of the third guide posts are fixed above the second rising and falling plate, and four of the third guide sleeves matched with the third guide posts are fixed at the top end of the machine frame; and two of the second cylinders are also fixed at the top end of the machine frame, and output ends of the second cylinders are hinged to the upside of the second rising and falling plate.

During actual use, the first cylinder enables the flange sleeve and the conical column to rise, the wheel is placed on the flange sleeve, the conical column subjects the wheel to centered locating, then, the first cylinder enables the wheel to fall until a lower wheel rim of the wheel is in contact with an inner ring of the clamp, and the third cylinders enable the pressing ring to compress the wheel through the second guide posts; at the same time, the second motor drives the upper brush to rotate, the second cylinders enable the upper brush to fall through the third guide posts, and burrs of the front surface can be removed when the upper brush is in contact with the front surface of the wheel; the first motor enables the outer ring and the first geared ring to rotate through the first synchronizing belt; the third motor enables the inner ring and the second geared ring to rotate through the second synchronizing belt, directions of rotation of the inner ring and the second geared ring are opposite to that of the outer ring, and then, a plurality of round brushes are driven to rotate through the gear; and the fourth cylinders enable the lower brush to rise through the first guide posts, and burrs of the back cavity of the wheel can be removed when the lower brush is in contact with the back cavity of the wheel.

According to the improved wheel deburring device, when in use, the burrs of the front surface and the back cavity of the wheel can be removed, the outer ring and the inner ring of the lower brush rotate separately, the round brushes can autorotate, and the corner burrs of the roots of the flanges of the wheels and the corner burrs of the roots of the rims of the wheels can be excellently removed; and meanwhile, the improved wheel deburring device has the characteristics of advanced technology, high degree of automation, high universality and safe and stable performance.

Figure 1:
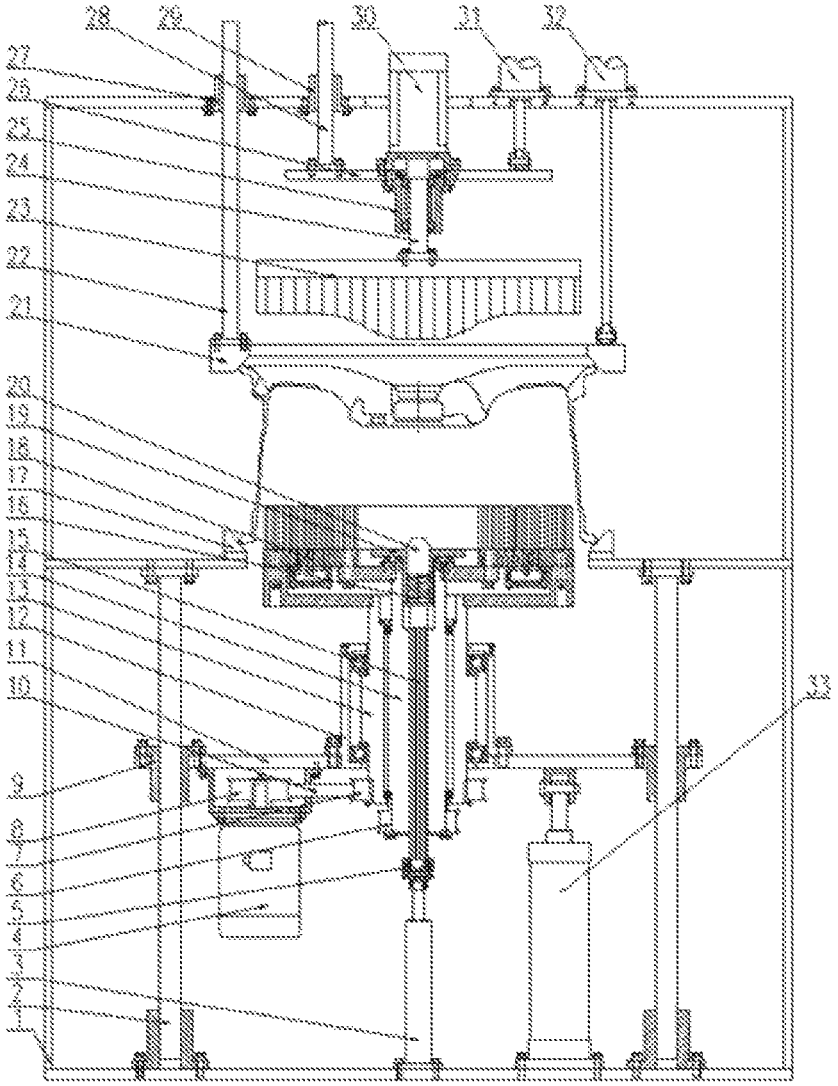
FIG. 1 is a front view of an improved wheel deburring device.
Figure 2:
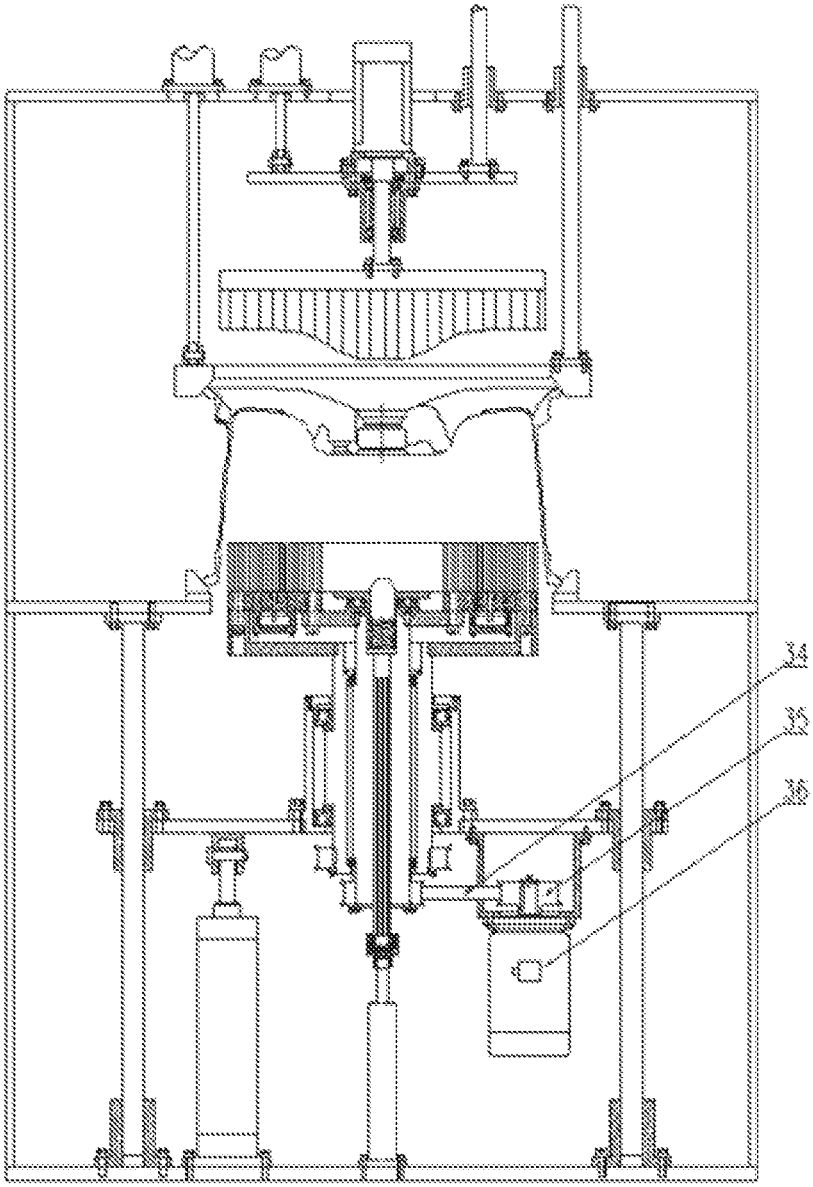
FIG. 2 is a left view of an improved wheel deburring device.
Figure 3:
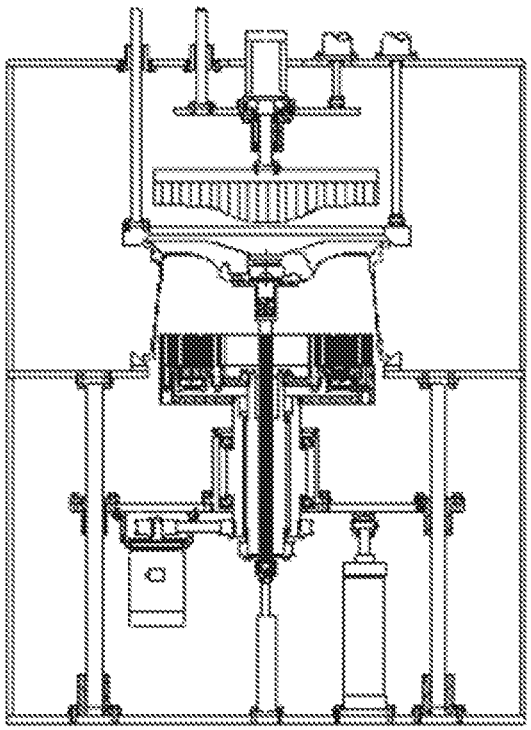
FIG. 3 is a front view of an improved wheel deburring device during work.
Figure 4:
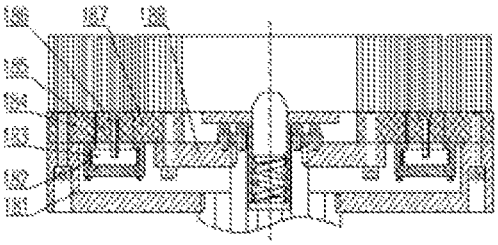
FIG. 4 is a front view of a lower brush of an improved wheel deburring device.
Figure 5:
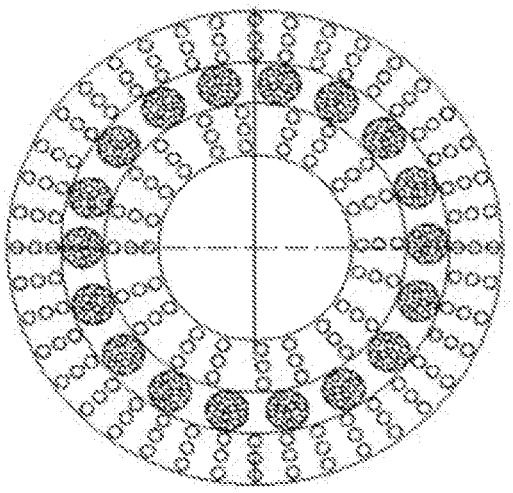
FIG. 5 is a top view of a lower brush of an improved wheel deburring device.

In the figures, numeric symbols are as follows: 1—machine frame, 2—a first guide post, 3—a first cylinder, 4—a first motor, 5—rotary joint, 6—a first belt pulley, 7—a second belt pulley, 8—a third belt pulley, 9—a first guide sleeve, 10—a first synchronizing belt, 11—a first rising and falling plate, 12—large bearing block. 13—hollow shaft. 14—spline housing, 15—spline shaft, 16—spring, 17—clamp, 18—lower brush. 19—flange sleeve, 20—conical column, 21—pressing ring, 22—a second guide post, 23—upper brush, 24—rotary shaft, 25—upper bearing block, 26—a second rising and falling plate, 27—a second guide sleeve, 28—a third guide post, 29—a third guide sleeve, 30—a second motor, 31—a second cylinder, 32—a third cylinder, 33—a fourth cylinder, 34—a second synchronizing belt, 35—a fourth belt pulley, 36—a third motor, 181—a first connecting plate, 182—a first geared ring, 183—gear, 184—outer ring, 185—round brush, 186—a second geared ring, 187—inner ring and 188—a second connecting plate.

DETAILED DESCRIPTION OF THE INVENTION

In the following, the details and working conditions of a specific device provided by the present invention are described in combination with the figures.

An improved wheel deburring device is composed of a machine frame 1, first guide posts 2, a first cylinder 3, a first motor 4, a rotary joint 5, a first belt pulley 6, a second belt pulley 7, a third belt pulley 8, first guide sleeves 9, a first synchronizing belt 10, a first rising and falling plate 11, a large bearing block 12, a hollow shaft 13, a spline housing 14, a spline shaft 15, a spring 16, a clamp 17, a lower brush 18, a flange sleeve 19, a conical column 20, a pressing ring 21, second guide posts 22, an upper brush 23, a rotary shaft 24, an upper bearing block 25, a second rising and falling plate 26, second guide sleeves 27, third guide posts 28, third guide sleeves 29, a second motor 30, second cylinders 31, third cylinders 32, fourth cylinders 33, a second synchronizing belt 34, a fourth belt pulley 35 and a third motor 36; four of first guide posts 2 are fixed between the bottom of the machine frame 1 and a working platform of the machine frame 1; four of first guide sleeves 9 matched with the first guide posts 2 are mounted on the first rising and falling plate 11; the first motor 4, of which an output end is provided with the third belt pulley 8, is fixed below the first rising and falling plate 11 through a flange; the third motor 36, of which an output end is provided with the fourth belt pulley 35, is also fixed below the first rising and falling plate 11 through a flange; the large bearing block 12 is fixed above the first rising and falling plate 11, and the hollow shaft 13 is mounted inside the large bearing block 12 through a bearing; the spline housing 14 is mounted inside the hollow shaft 13 through a bearing, and the spline shaft 15 is matched with the spline housing 14; the first cylinder 3 is fixed at the bottom of the machine frame 1, and an output end of the first cylinder 3 is connected to the downside of the spline shaft 15 through the rotary joint 5; the first belt pulley 6 is fixed at the downside of the spline housing 14; the second belt pulley 7 is fixed below the hollow shaft 13; the second belt pulley 7 and the third belt pulley 8 are connected through the first synchronizing belt 10; the first belt pulley 6 and the fourth belt pulley 35 are connected through the second synchronizing belt 34; two of fourth cylinders 33 are both fixed at the bottom of the machine frame 1, and output ends of the fourth cylinders 33 are hinged to the downside of the first rising and falling plate 11; and the conical column 20 is matched with the flange sleeve 19, and the spring 16 is arranged below the conical column 20. The lower brush 18 is mounted at the upper end of the hollow shaft 13 and the upper end of the spline housing 14; and the clamp 17 is fixed on the machine frame 1.

The lower brush 18 is composed of a first connecting plate 181, a first geared ring 182, a gear 183, an outer ring 184, round brushes 185, a second geared ring 186, an inner ring 187 and a second connecting plate 188. Both the first connecting plate 181 and the first geared ring 182 are fixed below the outer ring 184; the second geared ring 186 and the second connecting plate 188 are fixed below the inner ring 187; and a plurality of round brushes 185 are fixed above the gear 183, and the gear 183 is matched with the first geared ring 182 and the second geared ring 186.

Four of second guide posts 22 are separately fixed above the pressing ring 21, four of second guide sleeves 27 matched with the second guide posts 22 are fixed at the top end of the machine frame 1; two of third cylinders 32 are also fixed at the top end of the machine frame 1, and output ends of the third cylinders 32 are hinged to the upside of the pressing ring 21; the upper bearing block 25 is fixed below the second rising and falling plate 26, and the rotary shaft 24 is mounted in the upper bearing block 25 through a bearing; the upper brush 23 is fixed at the lower end of the rotary shaft 24; the second motor 30 is fixed above the second rising and falling plate 26, and an output end of the second motor 30 is connected to the upside of the rotary shaft 24; four of third guide posts 28 are fixed above the second rising and falling plate 26, and four of third guide sleeves 29 matched with the third guide posts 28 are fixed at the top end of the machine frame 1; and two of second cylinders 31 are also fixed at the top end of the machine frame 1, and output ends of the second cylinders 31 are hinged to the upside of the second rising and falling plate 26.

During work, the first cylinder 3 enables the flange sleeve 19 and the conical column 20 to rise, a wheel is placed on the flange sleeve 19, the conical column 20 subjects the wheel to centered locating, then, the first cylinder 3 enables the wheel to fall until a lower wheel rim of the wheel is in contact with an inner ring of the clamp 17, and the third cylinders 32 enable the pressing ring 21 to compress the wheel through the second guide posts 22; at the same time, the second motor 30 drives the upper brush 23 to rotate, the second cylinders 31 enable the upper brush 23 to fall through the third guide posts 28, and burrs of a front surface can be removed when the upper brush 23 is in contact with the front surface of the wheel; the first motor 4 enables the outer ring 184 and the first geared ring 182 to rotate through the first synchronizing belt 10; the third motor 36 enables the inner ring 187 and the second geared ring 186 to rotate through the second synchronizing belt 34, directions of rotation of the inner ring 187 and the second geared ring 186 are opposite to that of the outer ring 184, and then, a plurality of round brushes 185 are driven to rotate through the gear 183; and the fourth cylinders 33 enable the lower brush 18 to rise through the first guide posts 2, and burrs of a back cavity of the wheel can be removed when the lower brush is in contact with the back cavity of the wheel.

The invention claimed is:

1. An improved wheel deburring device, comprising: a machine frame, first guide posts, a first cylinder, a first motor, a rotary joint, a first belt pulley, a second belt pulley, a third belt pulley, first guide sleeves, a first synchronizing belt, a first rising and falling plate, a large bearing block, a hollow shaft, a spline housing, a spline shaft, a spring, a clamp, a lower brush, a flange sleeve, a conical column, a pressing ring, second guide posts, an upper brush, a rotary shaft, an upper bearing block, a second rising and falling plate, second guide sleeves, third guide posts, third guide sleeves, a second motor, second cylinders, third cylinders, fourth cylinders, a second synchronizing belt, a fourth belt pulley and a third motor; wherein four of the first guide posts are fixed between a bottom of the machine frame and a working platform of the machine frame; four of the first guide sleeves matched with the first guide posts are mounted on the first rising and falling plate; the first motor, which has an output end provided with the third belt pulley, is fixed below the first rising and falling plate through a flange; the third motor, which has an output end provided with the fourth belt pulley, is also fixed below the first rising and falling plate through a flange; the large bearing block is fixed above the first rising and falling plate, and the hollow shaft is mounted inside the large bearing block through a bearing; the spline housing is mounted inside the hollow shaft through a bearing, and the spline shaft is matched with the spline housing; the first cylinder is fixed at the bottom of the machine frame, and an output end of the first cylinder is connected to a downside of the spline shaft through the rotary joint; the first belt pulley is fixed at a downside of the spline housing; the second belt pulley is fixed below the hollow shaft; the second belt pulley and the third belt pulley are connected through the first synchronizing belt; the first belt pulley and the fourth belt pulley are connected through the second synchronizing belt; two of the fourth cylinders are both fixed at the bottom of the machine frame, and output ends of the fourth cylinders are hinged to a downside of the first rising and falling plate; and the conical column is matched with the flange sleeve, and the spring is arranged below the conical column; the lower brush is mounted at an upper end of the hollow shaft and an upper end of the spline housing; and the clamp is fixed on the machine frame; the lower brush comprises a first connecting plate, a first geared ring, a gear, an outer ring, round brushes, a second geared ring, an inner ring and a second connecting plate; wherein both the first connecting plate and the first geared ring are fixed below the outer ring; the second geared ring and the second connecting plate are fixed below the inner ring; and a plurality of round brushes are fixed above the gear, and the gear is matched with the first geared ring and the second geared ring; four of the second guide posts are separately fixed above the pressing ring, and four of the second guide sleeves matched with the second guide posts are fixed at a top end of the machine frame; two of the third cylinders are also fixed at the top end of the machine frame, and output ends of the third cylinders are hinged to an upside of the pressing ring; the upper bearing block is fixed below the second rising and falling plate, and the rotary shaft is mounted in the upper bearing block through a bearing; the upper brush is fixed at a lower end of the rotary shaft; the second motor is fixed above the second rising and falling plate, and an output end of the second motor is connected to an upside of the rotary shaft; four of the third guide posts are fixed above the second rising and falling plate, and four of the third guide sleeves matched with the third guide posts are fixed at the top end of the machine frame; and two of the second cylinders are also fixed at the top end of the machine frame, and output ends of the second cylinders are hinged to an upside of the second rising and falling plate.

* * * * *